US006416054B1

(12) United States Patent
Alfassi

(10) Patent No.: US 6,416,054 B1
(45) Date of Patent: Jul. 9, 2002

(54) MULTI-FUNCTION PUZZLE

(76) Inventor: David Alfassi, 11684 Ventura Blvd. #126, Studio City, CA (US) 91604

( * ) Notice: Subject to any disclaimer, the term of this patent is extended or adjusted under 35 U.S.C. 154(b) by 0 days.

(21) Appl. No.: 09/680,734

(22) Filed: Oct. 6, 2000

(51) Int. Cl.[7] ..... A63F 9/10
(52) U.S. Cl. ..... 273/157 R; 273/156; 446/126
(58) Field of Search ..... 273/157 R, 153 R, 273/156, 160; 446/126, 115

(56) References Cited

U.S. PATENT DOCUMENTS 1,229,580 A * 6/1917 Brown ..... 273/157 R
1,230,263 A * 6/1917 Alexander ..... 273/157 R
1,288,226 A * 12/1918 Schrader ..... 446/126
3,707,287 A * 12/1972 Spector ..... 273/157 R
4,302,900 A * 12/1981 Rayner ..... 446/126
4,552,361 A * 11/1985 LaFleur ..... 273/157 R
4,838,551 A * 6/1989 Volpert ..... 273/157 R
6,098,980 A * 8/2000 Ramahe et al. ..... 273/157 R

* cited by examiner

*Primary Examiner*—Steven Wong
(74) *Attorney, Agent, or Firm*—Goldstein & Lavas, P.C.

(57) ABSTRACT

A multi-function puzzle including a plurality of irregularly shaped puzzle pieces having uniform thickness which are capable of being joined together in a predetermined matrix. A tray is provided that is dimensioned for receiving the irregularly shaped puzzle pieces thereon in the predetermined matrix in a two-dimensional orientation. The tray has a central section having an upwardly extending peripheral sidewall with a height corresponding to the thickness of the puzzle pieces. The central section has a foam-padding layer disposed thereon. The foam-padding layer has a design thereon corresponding with the irregularly shaped puzzle pieces. A plurality of connectors are provided that each have a different arrangement of radially extending slots. The slots are dimensioned for receiving the irregularly shaped puzzle pieces therein in a three-dimensional orientation.

2 Claims, 4 Drawing Sheets

MULTI-FUNCTION PUZZLE

BACKGROUND OF THE INVENTION

The present invention relates to a multi-function puzzle and more particularly pertains to allowing puzzle pieces to be arranged both in two and three dimensional arrangements.

A standard two-dimensional "jigsaw" puzzle comprises an image depicted on a substantially flat board-like carrier. The carrier is cut, traditionally with a jigsaw, creating numerous substantially flat pieces which will only fit together when the player reconfigures the pieces in the position from which they were originally cut. The main objective in putting together typical two-dimensional or jigsaw puzzles is the assembly in the proper order to create a finished arrangement. Achieving this once or twice will typically render this type of puzzle useless to the owner who will more than likely have no motivation to complete this puzzle once again. Thus, the puzzle often sits in a closet or is discarded. Typical three-dimensional puzzles also often have limited solutions—thereby affording the owner of limited applications, designs, and thus enjoyment. What is needed is a puzzle that can be constructed both two-dimensionally and three dimensionally to increase the usability of the puzzle, and increase enjoyment to the user.

The present invention attempts to solve the above mentioned problem by providing a puzzle that can be used in both two- and three-dimensional designs.

The use of puzzles is known in the prior art. More specifically, puzzles heretofore devised and utilized for the purpose of figuring out a proper arrangement or solution are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,762,336 to Miller, Jr. discloses a three-dimensional interlocking puzzle. U.S. Pat. No. 3,417,505 to Schultz discloses space panels. U.S. Pat. No. 1,281,832 to Post discloses a toy building block. U.S. Pat. No. 597,519 to De Souchet discloses a toy. U.S. Pat. No. 4,343,471 to Calvert discloses a pentagonal puzzle. U.S. Pat. No. 3,827,177 to Wengel discloses a construction game.

While these devices fulfill their respective, particular objective and requirements, the aforementioned patents do not describe a multi-function puzzle for allowing puzzle pieces to be arranged both in two and three-dimensional arrangements. In this respect, the multi-function puzzle according to the present invention substantially departs from the conventional concepts and designs of the prior art, and in doing so provides an apparatus primarily developed for the purpose of allowing puzzle pieces to be arranged both in two and three dimensional arrangements.

Therefore, it can be appreciated that there exists a continuing need for a new and improved multi-function puzzle which can be used for allowing puzzle pieces to be arranged both in two and three dimensional arrangements. In this regard, the present invention substantially fulfills this need.

SUMMARY OF THE INVENTION

In the view of the foregoing disadvantages inherent in the known types of puzzles now present in the prior art, the present invention provides an improved multi-function puzzle. As such, the general purpose of the present invention, which will be described subsequently in greater detail, is to provide a new and improved multi-function puzzle, which has all the advantages of the prior art and none of the disadvantages.

To attain this, the present invention essentially comprises a plurality of irregularly shaped substantially flat puzzle pieces capable of being joined together in a predetermined matrix. A tray is provided that is dimensioned for receiving the irregularly shaped puzzle pieces thereon in the predetermined matrix in a two-dimensional orientation. The tray has a central section having an upwardly extending peripheral sidewall. The central section has a foam-padding layer disposed thereon. The foam-padding layer has a design thereon corresponding with the irregularly shaped puzzle pieces. A plurality of connectors are provided that each have a different arrangement of radially extending slots. The slots are dimensioned according to the thickness or the puzzle pieces for receiving said irregularly shaped puzzle pieces therein to create a three-dimensional object.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-function puzzle, which has all the advantages of the prior art puzzles, and none of the disadvantages.

It is another object of the present invention to provide a new and improved multi-function puzzle, which may be easily and efficiently manufactured and marketed.

It is a further object of the present invention to provide a new and improved multi-function puzzle, which is of durable and reliable construction.

An even further object of the present invention is to provide a new and improved multi-function puzzle which is susceptible of a low cost of manufacture with regard to both materials and labor, and which accordingly is then susceptible of low prices of sale to the consuming public, thereby making such multi-function puzzle economically available to the buying public.

Even still another object of the present invention is to provide a new and improved multi-function puzzle for allowing puzzle pieces to be arranged both in two and three-dimensional arrangements.

Lastly, it is an object of the present invention to provide a new and improved multi-function puzzle including a plurality of irregularly shaped puzzle pieces capable of being joined together in a predetermined matrix. A tray is provided that is dimensioned for receiving the irregularly shaped puzzle pieces thereon in the predetermined matrix in a two-dimensional orientation. The tray has a central section having an upwardly extending peripheral sidewall. The central section has a foam-padding layer disposed thereon. The foam-padding layer has a design thereon corresponding with the irregularly shaped puzzle pieces. A plurality of connectors are provided that each have a different arrangement of radially extending slots. The slots are dimensioned for receiving the irregularly shaped puzzle pieces therein in a three-dimensional orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
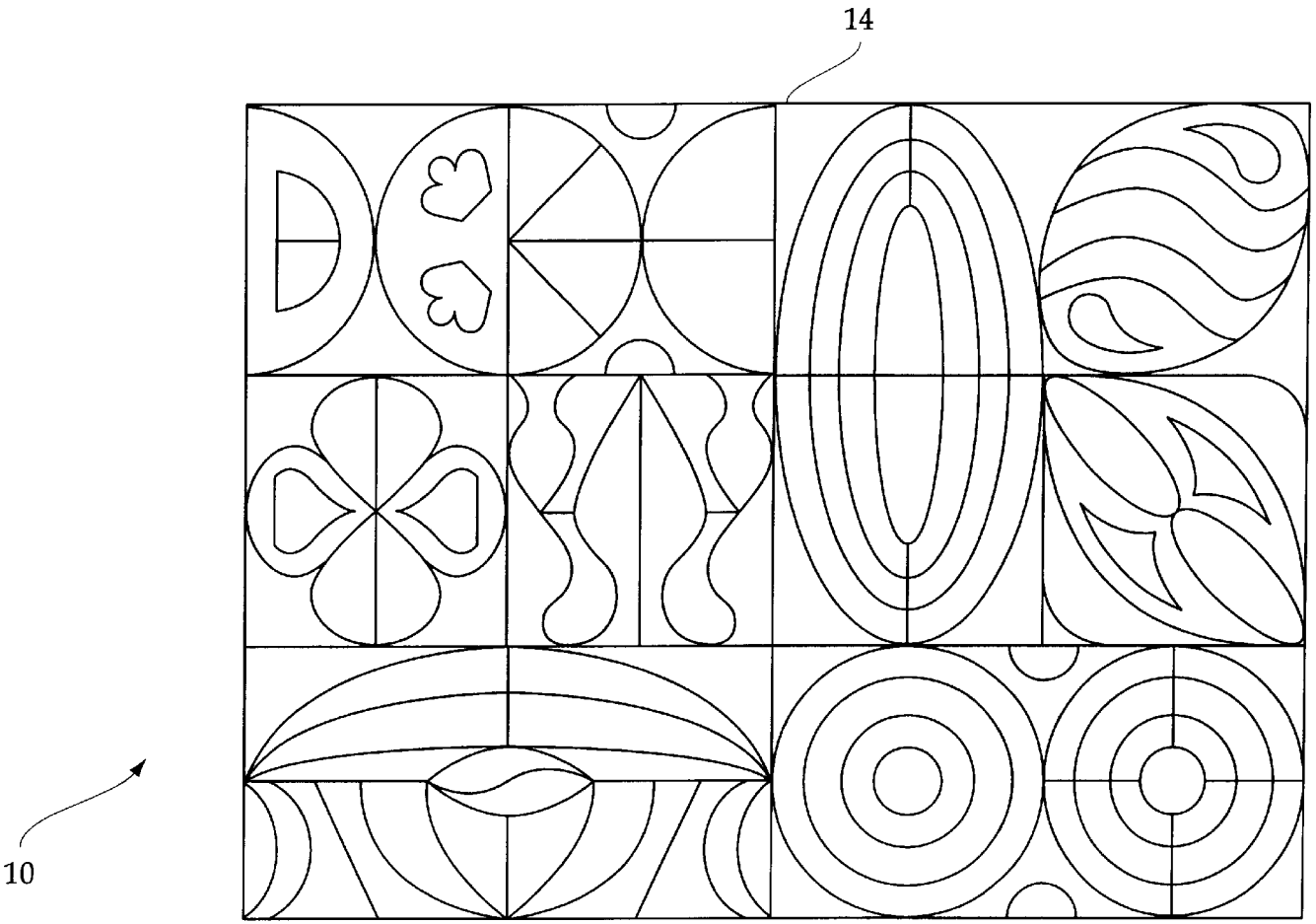
FIG. 1 is a perspective view of the preferred embodiment of the multi-function puzzle constructed in accordance with the principles of the present invention.
Figure 2:
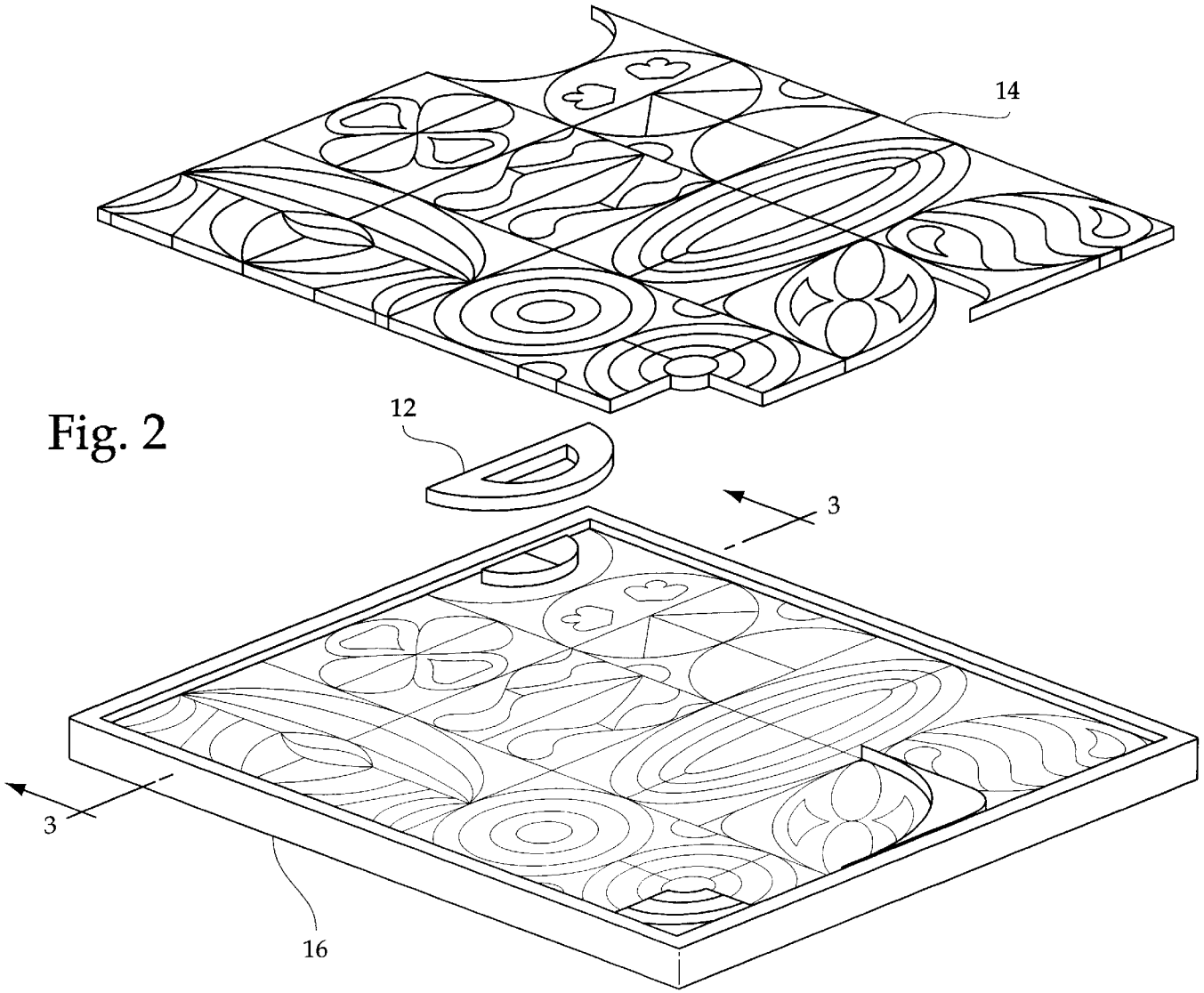
FIG. 2 is an exploded perspective view of the present invention.
Figure 3:
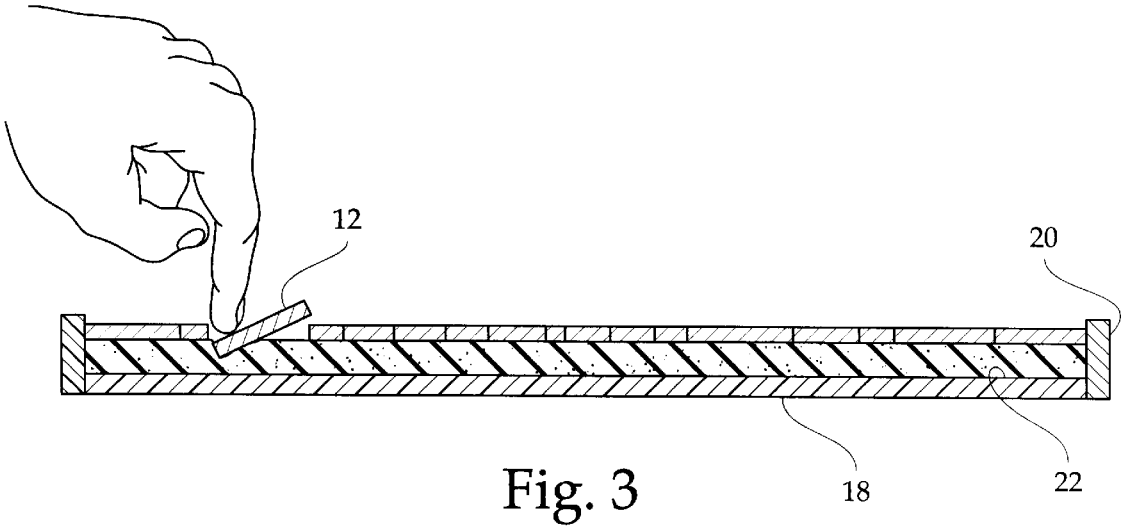
FIG. 3 is a cross-sectional view of the present invention as taken along line 3—3 of FIG. 2.
Figure 4:
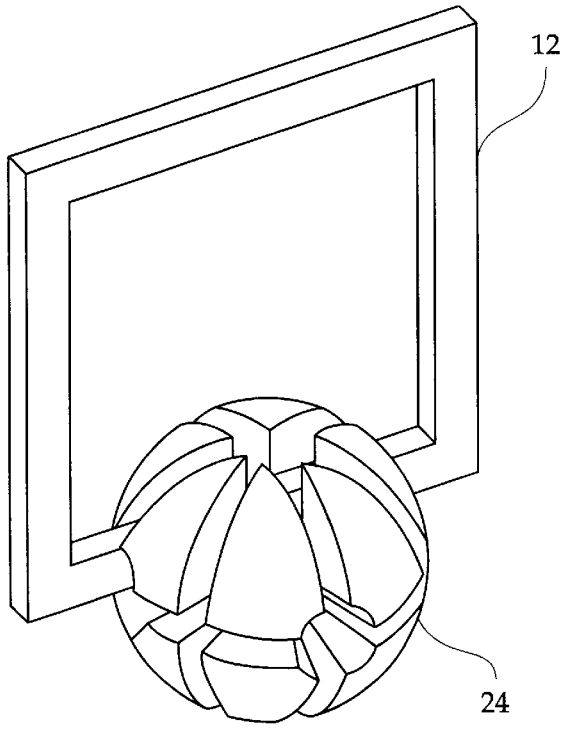
FIG. 4 is a perspective view of the present invention illustrated in a three-dimensional orientation.
Figure 5:
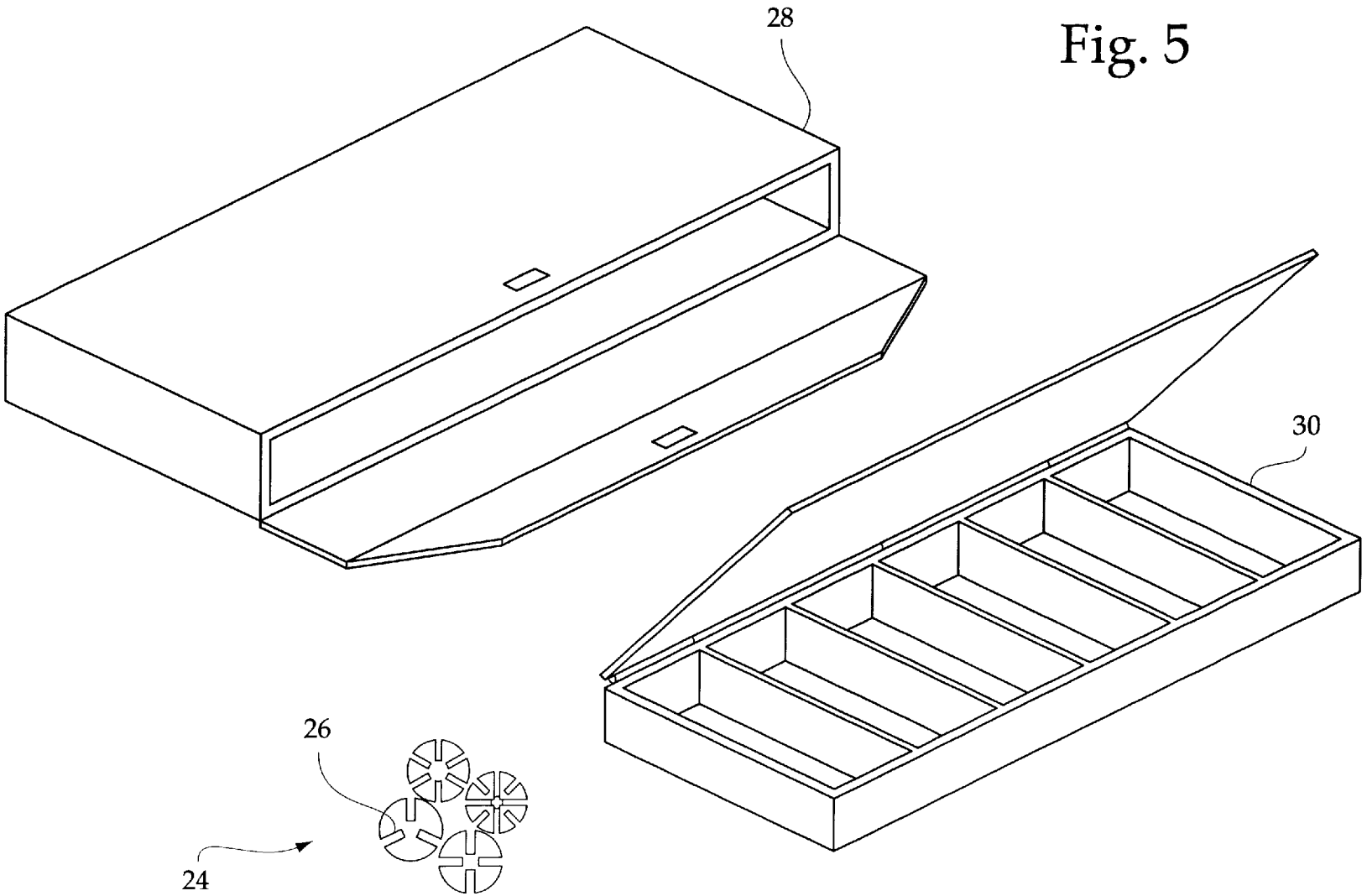
FIG. 5 is a perspective view of the connecting pieces and carrying case of the present invention.

With reference now to the drawings, and in particular, to FIGS. 1 through 5 thereof, the preferred embodiment of the new and improved multi-function puzzle embodying the principles and concepts of the present invention and generally designated by the reference number 10 will be described.

Specifically, it will be noted in the various Figures that the device relates to a multi-function puzzle for allowing puzzle pieces to be arranged both in two and three dimensional arrangements. In its broadest context, the device consists of a plurality of substantially planar, irregularly shaped puzzle pieces, a tray, and a plurality of connectors. Such components are individually configured and correlated with respect to each other so as to attain the desired objective.

The plurality of irregularly shaped puzzle pieces 12 are capable of being joined together in a predetermined matrix 14. Note FIG. 1. The puzzle pieces 12 may be described as planar, or substantially flat. They may also be described as being of substantially uniform thickness.

The tray 16 is dimensioned for receiving the irregularly shaped puzzle pieces 12 thereon in the predetermined matrix 14 in a two-dimensional orientation. The tray 16 has a central section 18 having an upwardly extending peripheral sidewall 20. The upwardly extending peripheral sidewall 20 corresponds in height to the thickness of the puzzle pieces 12. The central section 18 has a foam padding layer 22 disposed thereon. The foam-padding layer 22 has a design thereon corresponding with the irregularly shaped puzzle pieces 12. The design could either be printed directly on the foam padding layer 22 or could be an inlay that can be placed atop the foam padding layer 22. Note FIG. 2. The second option allows for different designs to be placed within the tray 16 for the puzzle pieces 12 to be aligned with. Additionally, the foam padding layer 22 allows for the puzzle pieces 12 to be removed more easily simply by pressing down on the one edge of the puzzle piece 12 in order to raise an opposed edge in order to be grasped for removal. Note FIG. 3.

The plurality of connectors 24 are typically spherical in shape, and each have a different arrangement of radially extending slots 26. The slots 26 are spaced around the sphere of said connectors 24 to allow different configurations and connections of puzzle pieces 12 to be accomplished. The slots 26 are dimensioned to have a width which corresponds with the uniform thickness of the puzzle pieces, for receiving said irregularly shaped puzzle pieces 12 therein in a three-dimensional orientation, so as to begin creating a three-dimensional object. The puzzle pieces 12 will extend outwardly from the connectors 24, note FIG. 4, to form an essentially circular shape. Additionally, the present invention will include a carrying case 28 with a removable tray 30 that can be used to hold and categorize the plurality of connectors 24. Note FIG. 5. Furthermore, the connectors 24 can be connected to one another with the puzzle pieces 12 to create more interesting shapes. Note FIG. 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A multi-function puzzle for allowing puzzle pieces to be arranged both in two and three-dimensional arrangements comprising, in combination:

a plurality of irregularly shaped puzzle pieces, said puzzle pieces being substantially flat and of uniform thickness, capable of being joined together in a predetermined matrix;

a tray dimensioned for receiving the irregularly shaped puzzle pieces thereon in the predetermined matrix in a two-dimensional orientation, the tray having a central section having an upwardly extending peripheral side wall corresponding in height to the thickness of the puzzle pieces, the central section having a foam padding layer disposed thereon, the foam padding layer having a design thereon corresponding with the irregularly shaped puzzle pieces; and a plurality of connector spheres, having an arrangement of radially extending slots, the slots being dimensioned for receiving the irregularly shaped puzzle pieces therein in a three-dimensional orientation.

2. A multi-function puzzle and method for allowing puzzle pieces to be arranged both in two and three-dimensional arrangements comprising, in combination:

providing a plurality of substantially flat irregularly shaped puzzle pieces of uniform thickness capable of being joined together in a predetermined matrix in a substantially flat arrangement;

providing a tray dimensioned for receiving the irregularly shaped puzzle pieces thereon in the predetermined matrix in a two-dimensional orientation, the tray having a central section having an upwardly extending peripheral side wall, the central section having a foam padding layer disposed thereon, the foam padding layer having a design thereon corresponding with the irregularly shaped puzzle pieces;

providing a plurality of connectors, each having a different arrangement of radially extending slots, the slots being dimensioned for receiving the irregularly shaped puzzle pieces therein in a three-dimensional orientation; and wherein the puzzle pieces can be placed within the tray to form a two-dimensional puzzle and be merged with the circular disks to form a three-dimensional puzzle.

* * * * *